US005742947A

United States Patent [19]

Davis

[11] Patent Number: 5,742,947

[45] Date of Patent: Apr. 28, 1998

[54] ADJUSTABLE CHEST PROTECTOR

[76] Inventor: James B. Davis, 3553 Bellerive Cir., August, Ga. 30907

[21] Appl. No.: 719,502

[22] Filed: Sep. 25, 1996

Related U.S. Application Data

[63] Continuation-in-part of Ser. No. 438,309, May 10, 1995.

[51] Int. Cl.[6] ..... A41D 13/00

[52] U.S. Cl. ..... 2/463; 2/908; 2/465; 2/455

[58] Field of Search ..... 2/92, 908, 456, 2/465, 463, 467, 455

[56] References Cited

U.S. PATENT DOCUMENTS

| | | |
|---|---|---|
| 1,000,297 | 8/1911 | Sagerstrom . |
| 1,239,980 | 9/1917 | Stewart . |
| 1,241,025 | 9/1917 | Sagerstrom . |
| 1,414,136 | 4/1922 | Kleiminger . |
| 2,001,508 | 5/1935 | Tobin . |
| 2,990,549 | 7/1961 | Doughty . |
| 3,574,861 | 4/1971 | Hale . |
| 4,084,264 | 4/1978 | Marion . |
| 4,353,133 | 10/1982 | Williams . |
| 4,373,211 | 2/1983 | Goudreau et al. . |
| 4,514,862 | 5/1985 | A'Costa . |
| 5,168,576 | 12/1992 | Krent et al. . |

*Primary Examiner*—Paul C. Lewis
*Attorney, Agent, or Firm*—Needle & Rosenberg, P.C.

[57] ABSTRACT

An adjustable chest protector to prevent athletic injuries, particularly in baseball. The chest protector is C-shaped in a horizontal plane and designed to fit comfortably and unnoticeably underneath clothing of the user. It is also designed to allow free, unhindered movement by the athlete. The chest protector nevertheless is strong enough to prevent potentially fatal injuries. A portion of the protector is contoured convexly away from the user to assume the natural shape of the user's hemithorax.

14 Claims, 2 Drawing Sheets

ADJUSTABLE CHEST PROTECTOR

This application is a continuation-in-part of application Ser. No. 08/438,309, filed May 10, 1995, which is pending.

BACKGROUND OF THE INVENTION

1. Field of the Invention

The present invention relates to a hardened shell to protect a person from injuries. More particularly, the present invention relates to a protector to be used by baseball players, particularly to Little League players, that fits comfortably and unnoticeably below the uniform of the person.

2. Background Art

Baseball can be hazardous, even deadly, for children. The most dangerous time occurs when the players are batting. The obvious risk is that the batter could be hit in the head by a pitch and suffer a severe injury. Leagues thus require batters to wear helmets to protect against this type of injury.

Another injury, although lesser known, is blunt chest trauma caused by a batter being hit by a baseball in the chest. In fact, the most common lethal or severe injuries suffered by youngsters involves chest injuries. The result of such an occurrence can be bruises, broken ribs, or even a cardiac concussion. A cardiac concussion, known as commotio cordis, is a functional injury that affects and individuals heart. A cardiac concussion is more likely to have an immediate, dire consequence than a structural injury, such as a cardiac rupture. See Thomas J. Abrunzo, M.D., *Commotio Cordis, The Single, Most Common Cause of Traumatic Death in Youth Baseball,* AMERICAN JOURNAL OF DRESSES IN CHILDREN, Vol. 145, 1279–1282 (November 1991).

Even more pertinent, blunt chest trauma is reported to cause two to three deaths in youth baseball each year. Id. Therefore, a need exists to protect children from this potentially fatal injury. One solution is a "reduced injury factor" ball. This solution, however, has its weaknesses, namely, that the ball only partially minimizes the chance of fatal blunt chest trauma. Use of this type of ball alone does not eliminate the chance of severe injury, and minor injuries are still common.

Another solution is protective vests. These vests resemble catcher's chest protectors or water ski life vests. Often these protectors are worn after an injury has occurred, e.g., to prevent re-injury.

Use of these vests has been stymied both by the requirements of Little League rules and the reception by the youngsters. Children are embarrassed to wear something that is odd, bulky, or looks different from what their peers or the older players are wearing. Furthermore, most local Little League rules require specific uniforms which cannot be altered or covered. Thus, in spite of the danger to children, Little League rules restrict protective vests that exist in the prior art from being used. And, in addition to these drawbacks, the vest protectors often do not provide an adequate level of protection since some are only made of cloth or fabric.

Thus, there is a need for a protector for athletes that is not bulky. Such a protector must be able to satisfy local Little League rules and it should not appear out of context with a normal uniform so that children are not embarrassed to wear such an important device.

SUMMARY OF THE INVENTION

The above disadvantages of the prior art are overcome by the present invention which provides a chest protector that protects athletes, but is not readily noticeable by others. The present invention comprises a hardened shell to be fitted beneath the outer garment of the person and a means to attach this shell to the person. The present invention, at a minimum, covers at least a portion of the thorax, ribs, and the lateral torso. A portion of the shell is contoured convexly away from the person to assume the natural shape of the hemithorax of the user.

The present invention preferably has a wrap-around appearance that extends from the sternum anteriorly to the spine posteriorly and is contoured in a fashion not to interfere with the movement of the shoulder, both superiorly and laterally in the region of the underarm. In addition to being contoured convexly away from the body so that it will assume the natural shape of the hemithorax, the present invention preferably also contours anteriorly to assume the shape of the outward bowing of the pectoralis muscle and contours posteriorly to assume the outward bowing that occurs by the normal position of the scapula and muscles associated with the upper back and scapula. The present invention is also contoured superiorly both posteriorly and anteriorly in a convex fashion that allows for normal movement of the shoulder girdle.

The present invention can be made in different sizes to cover a broader area of the person's body. For example, the protector can cover up to the upper abdominal cavity on one half of the body of the person. The present invention can also be adjustable in the lateral direction to accommodate different sizes of players, different growth rates of children, and different shapes of users.

The present invention also provides a protector that is comfortable and does not hinder movement of the athlete. In fact, the present invention can comfortably be worn for the entire baseball game or practice without removal during the periods that the player is fielding.

The protector also acts as a confidence builder for the person wearing it because of the safety factor. The natural result is that the batter will be more secure, and thus more effective. The present invention is most useful to children in the preadolescent age by protecting them from major injury and giving them additional confidence. However, the present invention is valuable to people of all ages and can be useful in other sports, such as hockey, lacrosse, and the like.

DETAILED DESCRIPTION OF THE INVENTION

The present invention may be understood more readily by reference to the following detailed description of specific embodiments aid the Figures included therein. As used in the specification and in the claims, "a" can mean one or more depending on the context.

Referring generally to FIGS. 1–4, one embodiment of the present invention comprises an apparatus for protecting a person P from a chest or torso injury. The protector 10 has a hardened shell 20 and a means for removably securing the hardened shell 20 to the person P.

Figure 2:
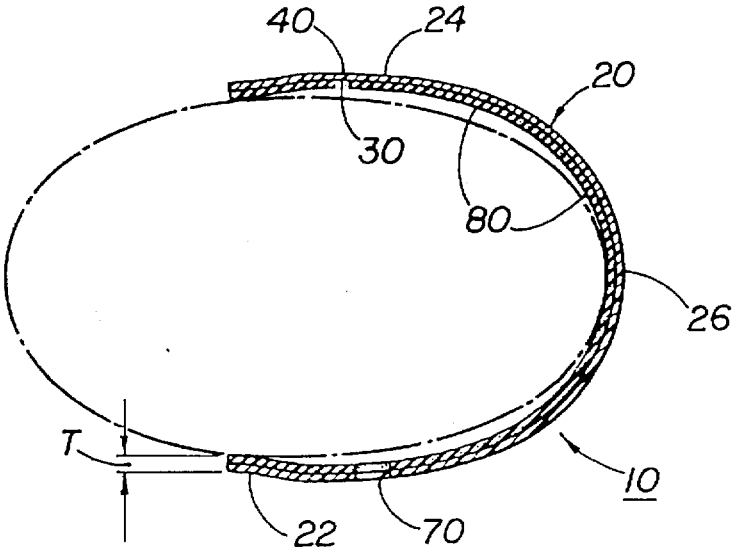
FIG. 2 is a top view take along line 2—2 in FIG. 1.

The hardened shell 20 is essentially C-shaped as viewed in a horizonal plane, as shown in FIG. 2. The shell 20 is integrally formed of a first section 22, second section 24, and an intermediate or third section 26. Each section 22, 24, 26 has an interior side 30 to be adjacent to the person P, an opposite exterior side 40, and a thickness T separating the interior side 30 and the exterior side 40. The thickness T is selected to allow the hardened shell 20 to be fitted comfortably beneath the outer garment of the person P. It is desired that the thickness T be sufficiently thin that the hardened shell 20 is not noticeable by others, yet sufficiently strong to protect the user. In other words, the present invention is a form fitting, contoured protector 10 that protects the left hemithorax and chest and is designed to be worn under the outer clothing in a fashion that allows a comfortable fit.

The protector 10 can be worn during active play in a baseball game. While other sports may use this apparatus, it is predominately designed for use during the entire game of baseball, both batting and fielding. The present invention, in other words, is not designed as a batting vest only, but is designed to be comfortable and allow for full range of motion required during playing baseball.

Figure 1:
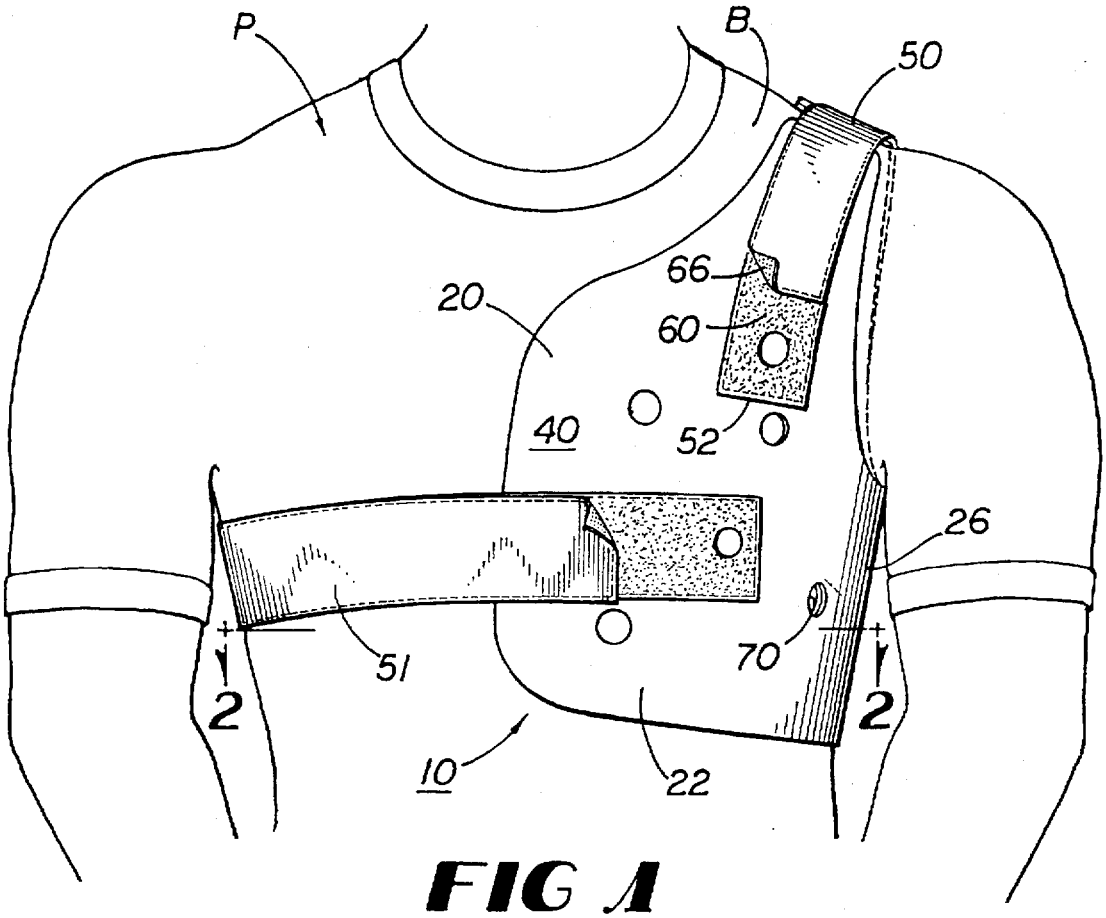
FIG. 1 is a front view of the present invention.
Figure 3:
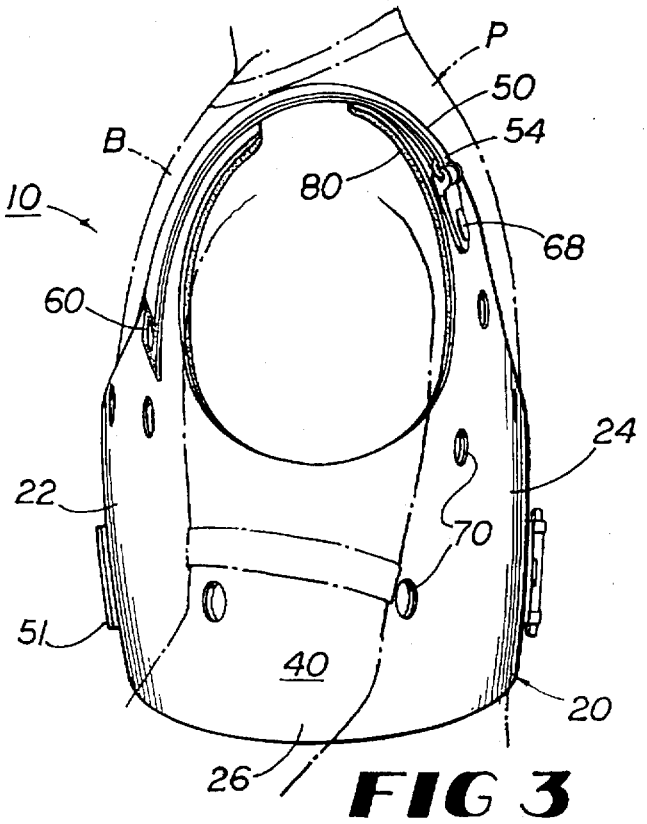
FIG. 3 is a side view of the present invention.
Figure 4:
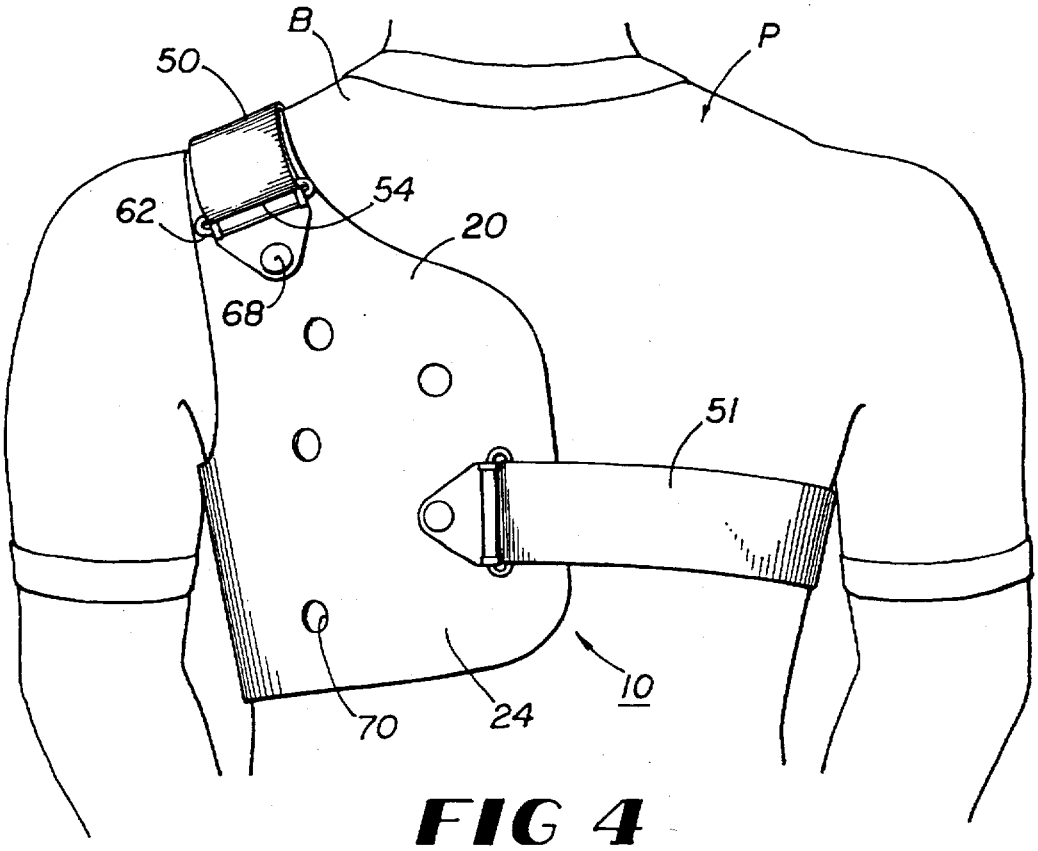
FIG. 4 is a back or end view of the present invention.

As shown in FIGS. 1, 3, and 4, the first section 22 of the hardened shell 20 covers at least a portion of the anterior thorax and ribs, the second section 24 covers at least a portion of the posterior thorax and ribs, and the third section 26 covers the lateral torso therebetween.

Other regions of the body B can be covered, and thus protected, by the hardened shell 20. The first section 22 and the second section 24 of the hardened shell 20 can cover opposing sides of the scapula of the person P. The first and second sections 22, 24 can also extend sufficiently above the person's arm to protect the clavicle. The second section 24 can cover a portion of the thoracic vertebrae, or the first section 22 can protect the sternum of the person P.

Likewise, the hardened shell 20 can cover one half of the fib cage and the thorax on one half body B. The hardened shell 20 can protect at least a portion of the abdominal cavity of the person P or the upper abdominal cavity on one half of the body B of the person P. As is evident, if the person P who uses the present invention is a right-handed batter, the hardened shell 20 covers the left side of the body B. Likewise, if the batter is left-handed, the hardened shell 20 covers the fight side of the body B. The organs that can be protected for right-handed batters include the heart, lungs, liver, intestines, diaphragm, and spleen. For a left-handed batter, the organs that can be protected include the heart, lungs, liver, intestines, diaphragm, and gall bladder.

The present invention is preferably contoured convexly away from the body B in its entire dimensions and has a wrap-around appearance that extends from the sternum anteriorly to the spine posteriorly and is contoured in a fashion not to interfere with the movement of the shoulder, both superiorly and laterally in the region of the underarm. The protector 10 is contoured convexly away from the body B so that it will assume the natural shape of the hemithorax, but also has contours anteriorly to assume the shape of the outward bowing of the pectoralis muscle and contours posteriorly to assume the outward bowing that occurs by the normal position of the scapula and muscles associated with the upper back and scapula. The protector 10 is also contoured superiorly both posteriorly and anteriorly in a convex fashion that allows for normal movement of the shoulder girdle.

The securing means of the present invention, as shown in FIGS. 1, 3, and 4, comprises at least one strap 50 having opposing ends 52, 54, a first pair of engageable fasteners 60, 62 fixedly attached to the opposing ends 52, 54 of each strap 50, and a corresponding second pair of mating engageable fasteners 66, 68 fixedly attached to the exterior side 40 of the hardened shell 20. The first pair of fasteners 60, 62 can be removably engaged with the corresponding second pair of fasteners 66, 68 so that the hardened shell 20 can be removably secured to the person P.

In the preferred embodiment, there are two straps 50, 51. One strap 50 connects the first section 22 and the second section 24 of the hardened shell 20 and extends over the shoulder adjacent the hardened shell 20. The second strap 51 extends around the torso of the person P opposite the third section 26 of the hardened shell 20. Each strap preferably is three inches wide and made of a strong material, such as nylon."

The first pair of engageable fasteners 60, 62 and second pair of engageable fasteners 66, 68 are complementary hook-and-loop fasteners, commonly known as "VELCRO®." Alternatively, the first pair of engageable fasteners 60, 62 and second pair of engageable fasteners 66, 68 can be complementary snap fasteners.

The straps 50, 51 preferably are adjustable to change the distance between the opposing ends 52, 54. The adjustment may be facilitated or assisted if "VELCRO®" fasteners are used by the placement of the opposing ends 52, 54 relative to the corresponding second pair of fasteners 66, 68 on the hardened shell 20.

Preferably, the hardened shell 20 is adjustable. The adjustments can be made laterally by the strap 50 that extends superiorly over the shoulder of the person P. The hardened shell 20 can also be adjusted around the chest or girth. Thus, the present invention can accommodate different sizes, shapes, and growth rates of the users.

With the protector 10 secured superiorly and around the girth, the inferior extent of the apparatus extends downwardly to the upper border of the 12th rib posteriorly and around the anterolateral costocartilaginous rib cage anterolaterally. The present invention, thus, protects the areas needed to be protected, but also allows for full function during the sport of baseball. There is no limitation to movement of the shoulder girdle and no limitation of movement to bending or stretching either backward and forward or side to side.

It is also preferred that the hardened shell 20 has a plurality of aeration holes 70 therethrough. This allows the body to breathe so that sweat does not accumulate beneath the interior side 30 of the hardened shell 20.

As shown in FIG. 2, it is also preferable that the present invention further comprise a soft, flexible liner 80 fixedly attached to the interior side 30 of the hardened shell 20. Glue is an acceptable means to attach such a liner 80.

The hardened shell 20 can be constructed of any malleable, durable material that can withstand the force of a direct impingement of a baseball and still protect the user. The preferred material is a polyethylene compound. The hardened shell 20 can be formed by pouring the polyethylene into a plaster cast. If a baseball hits this hardened shell 20, the ball would ricochet thus protecting the person P from contusion, fracture, or other serious injury.

A prototype of the present invention constructed of polyethylene has been tested by a pitching machine throwing a baseball at up to 80 miles per hour with excellent results. There was no indication that the hardened shell 20 was cracked, bent, or otherwise deformed.

The present invention can be manufactured in several general sizes, with approximately two to three sizes being capable of adjusting to fit all users. The adjustable straps 50, 51 provide a snug, comfortable fit for any size or shape of person P who is using the present invention.

Although the present invention has been described with reference to specific details of certain embodiments thereof, it is not intended that such details should be regarded as limitations upon the scope of the invention except as and to the extent that they are included in the accompanying claims.

What I claim is:

1. An apparatus for protecting a person wearing an outer garment from a chest or torso injury, comprising:

(a) a hardened shell being essentially C-shaped in a horizonal plane and comprising a first section, a second section, and an intermediate or third section, wherein the hardened shell is substantially rigid so that the hardened shell is not movable so as to be essentially linear in the horizontal plane, each section having an interior side to be adjacent to the person, an opposite exterior side, and a thickness separating the interior and the exterior sides, wherein the first section of the hardened shell extends downwardly and terminates adjacent the anterior thorax and ribs and extends up to and terminates adjacent the clavicle, the second section of the hardened shell extends downwardly to cover and terminates adjacent the posterior thorax and ribs and extends upwardly and terminates adjacent the clavicle, and the third section of the hardened shell covers the lateral torso therebetween so that the hardened shell extends from the sternum anteriorly to the spine posteriorly, a portion of the hardened shell being contoured convexly away from the person to assume the natural shape of the hemithorax of the person; and b) means for removably securing the hardened shell to the person.

2. The apparatus of claim 1, wherein the first section of the hardened shell contours anteriorly to assume the shape of the pectoralis muscle of the person and the second section contours posteriorly to assume the shape of the muscles associated with the upper back and scapula.

3. The apparatus of claim 1, wherein the first section and the second section cover opposing sides of the scapula of the person.

4. The apparatus of claim 1, wherein the hardened shell covers one half of the rib cage, the thorax on one half body, and the organs contained therein of the person.

5. The apparatus of claim 1, wherein the second section covers a portion of the thoracic vertebrae of the person.

6. The apparatus of claim 1, wherein the first section covers the sternum of the person.

7. The apparatus of claim 1, wherein the hardened shell covers the abdominal cavity on one half of the body of the person.

8. The apparatus of claim 1, wherein the securing means comprises at least one strap having opposing ends, a first pair of engageable fasteners fixedly attached to the opposing ends of each strap, and corresponding second pair of mating engageable fasteners fixedly attached to the exterior side of the hardened shell, wherein each first pair of fasteners can be removably engaged with corresponding second pair of fasteners, thereby removably securing the hardened shell to the person.

9. The apparatus of claim 8, wherein there are two straps, one strap connecting the first section and the second section of the hardened shell and extending over one shoulder of the person adjacent the hardened shell and second strap a extending around the torso of the person opposite the third section of the hardened shell.

10. The apparatus of claim 8, wherein the first pair and second pair of engageable fasteners are complementary hook-and-loop fasteners.

11. The apparatus of claim 8, wherein the strap is adjustable to change the distance between the opposing ends.

12. The apparatus of claim 1, wherein the hardened shell has a plurality of aeration holes therethrough.

13. The apparatus of claim 1, further comprising a soft, flexible liner fixedly attached to the interior side of the hardened shell.

14. The apparatus of claim 1, wherein the hardened shell is comprised of a polyethylene compound.

* * * * *

UNITED STATES PATENT AND TRADEMARK OFFICE

CERTIFICATE OF CORRECTION

PATENT NO. : 5,742,947

DATED : April 28, 1998

INVENTOR(S) : James B. Davis

It is certified that error appears in the above-identified patent and that said Letters Patent is hereby corrected as shown below:

Col. 1, line 32, "DRESSES" should be --DISEASES--

Signed and Sealed this

Eleventh Day of August 1998

Bruce Lehman

*Attest:*

BRUCE LEHMAN

*Attesting Officer*

*Commissioner of Patents and Trademarks*